US010147404B2

(12) United States Patent
Campling

(10) Patent No.: US 10,147,404 B2
(45) Date of Patent: Dec. 4, 2018

(54) CAPO

(71) Applicant: C7th Limited, Peterborough, Cabridgeshire (GB)

(72) Inventor: Nicholas John Campling, Peterborough (GB)

(73) Assignee: C7th Limited, Peterborough (GB)

( * ) Notice: Subject to any disclaimer, the term of this patent is extended or adjusted under 35 U.S.C. 154(b) by 0 days.

(21) Appl. No.: 15/602,509

(22) Filed: May 23, 2017

(65) Prior Publication Data

US 2018/0102113 A1 Apr. 12, 2018

(30) Foreign Application Priority Data

Oct. 10, 2016 (GB) ..... 1617201.7

(51) Int. Cl.
*G10D 3/04* (2006.01)

(52) U.S. Cl.
CPC ..... *G10D 3/043* (2013.01)

(58) Field of Classification Search
CPC ..... G10D 3/043
See application file for complete search history.

(56) References Cited

U.S. PATENT DOCUMENTS

| | | | | |
|---|---|---|---|---|
| 4,301,705 | A | 11/1981 | Gould | |
| 5,623,110 | A * | 4/1997 | Hoglund | G10D 3/043 84/318 |
| 6,271,448 | B1 | 8/2001 | Steinberger | |
| 2016/0247490 | A1 | 8/2016 | Campling et al. | |

* cited by examiner

*Primary Examiner* — Kimberly Lockett
(74) *Attorney, Agent, or Firm* — Endurance Law Group PLC

(57) ABSTRACT

A curvature adaption mechanism to be incorporated with a capo (10) for use with a guitar includes a cam surface (16, 17, 19) and associated cam follower surface (12) located behind a string contact surface (11). A curvature of the guitar fingerboard and strings can be adopted by the string contact surface (11) by virtue of cams engaging and providing a feedback force (D).

15 Claims, 6 Drawing Sheets

CAPO

BACKGROUND OF THE INVENTION

Field of the Invention

The present invention relates to a capo for a stringed instrument such as a guitar or banjo. Particularly, the capo is intended to be able to adapt to the curvature of a finger board and/or strings to which it is applied.

Description of Related Art

A capo (sometimes referred to as a capodastro, capodaster, capotasto or cejilla) is a well-known device used with a stringed instrument having a neck and a set of strings extending along the length of the neck. The capo, when applied to an instrument neck, serves to clamp the strings against a finger board and, in particular, between or against one of the number of fret bars disposed along the length of finger board. In practice, a capo serves to reduce the effective length of the strings and therefore adjust the pitch; i.e. the pitch is raised as the effective length of a string is shortened.

A large number of different capo types are known, each of which has a different advantage or technical consideration. However, most standard capo designs feature a relatively rigid clamping bar which reaches over the strings in order to apply downward pressure thereon. The clamping bar is usually a metal material with a rubber contact surface which has some resilience in order to accommodate strings and any minor curve across the instrument's neck. However, guitar finger boards vary in the radius that is desirable, ranging from flat on a classical style instrument to a radius of approximately 7.25 inches (18.4 cm) on some electric guitars. Many contemporary steel-string acoustic guitars have a radius across the finger board of 12 to 16 inches (30.5 to 40.6 cm). It is also known to apply a varying (compound) radius along the length of the finger board.

The radius of a finger board is also affected by the gauge of strings used on the instrument. For example, as illustrated in FIG. 1 of the accompanying drawings, a guitar neck N is shown having a finger board B and associated fret F with a radius which is effectively offset to one side by the gauge of the strings which increase in diameter (in order to produce lower frequencies) from right to left across the six strings S. The configuration could be reversed dependent on whether the instrument is left or right handed. As will be noted by a skilled person, FIG. 1 effectively shows all strings S pressed against fret F of the finger board B, as if with a capo applied.

It will be apparent that the radius of any capo clamping arm designed for pressing with even pressure against the finger board/fret, to enable strings to come into solid contact with a fret and avoid any "buzzing" of the strings, must take this into account. A common way for capo makers to address this problem is to use a resilient material such as rubber to press onto the strings. This allows the strings to press into the rubber locally and at a relatively even pressure between the strings. However, it is well known that this approach is only partially effective and can result in too much pressure on some strings, leading to sharp notes. Alternatively, insufficient pressure can result in unwanted vibrations or "buzzing".

The player may compensate for the above by adjusting the tuning, although clearly this is not ideal because it would prohibit a quick changeover during a performance when applying the capo or adjusting its position along the guitar neck.

The use of softer rubber can provide more flexibility/accommodation in the capo properties and adaptability to different curvatures, but soft rubber is also known to deaden the tone of guitar strings to some extent.

In an effort to address varying neck radius and string gauge US20160247490 proposes a capo incorporating a fluid insert to be located behind a string contacting pad such that the relatively incompressible nature of the fluid adapts a curvature of the string contacting pad (made of a resilient but relatively hard material) to match the combined curvature of the strings and instrument finger board itself. This solution, while effective, requires the fluid to be housed and incorporated with the capo clamp arm which complicates the manufacturing process.

BRIEF SUMMARY OF THE INVENTION

The present invention seeks to provide a capo with mechanical means to account for and adapt to curvature in the finger board. It may also enable equal pressure to be applied during clamping across the strings, thereby avoiding tonal inconsistencies. According to a broad aspect of the invention a capo for a stringed instrument is provided according to claims 1, 9 and 13.

The capo of the invention adapts a string contacting surface to the curvature of a finger board by use of a cam surface, struts or rocking block elements associated therewith, i.e. internally mounted with the clamp arm of the capo. In a first embodiment, as the capo clamps onto a finger board by contact with an apex of the finger board curvature, via the string contacting surface, this displaces a sliding element within the clamp arm that subsequently causes, via linear cam mating parts or hinged struts, the string contacting surface to become curved in reaction to the fingerboard shape pressed into it. Due to the nature of the construction the curve forms before significant force is applied to the strings. In principle, the string contact surface may begin in either a straightened or maximally curved configuration where force from the finger board curve (either at the apex in the case of a flat contact surface or one or both side edges in the case of the curved initial configuration) as the capo is clamped on the instrument creates a feedback force which imparts a curvature to match the particular finger board curvature.

The invention suggests a purely mechanical curve adaptive means, as opposed to a curve being formed by an impression into fluid, gel or the like. Such a solution contributes to ease of manufacture and maintenance since a fluid (i.e. leakable) component is not required.

In the known way, the string contacting surface generally has a solid/stiff quality provided by a certain thickness and/or hardness in order to provide a suitably firm surface against which the strings are clamped. Preferably the element will be resilient, i.e. capable of springing back to shape but, more importantly, it will provide a firm surface for contact with the strings while being capable of bending to the sum curvature of the finger board/fret plus strings. Alternative forms could feature a string dampening aspect where a softer material is used to contact the strings, but otherwise including a cam surface and curvature adaption according to the invention.

The invention, as an integral component of a clamping arm, can be incorporated into any type of capo, for example (but not limited to) a spring, clutch, elastic or screw tightened device.

BRIEF DESCRIPTION OF THE SEVERAL VIEWS OF THE DRAWINGS

FIGS. 2*a* to 4*a* illustrate side views of a curvature adaption mechanism according to the invention in stages of use, from an initial configuration wherein a string contact surface is straight to a final configuration wherein the string contact surface is curved;

FIGS. 2*b* to 4*b* illustrate side views of the curvature adaption mechanism according to the invention in stages of use, from an initial configuration wherein the string contact surface is curved to a final configuration wherein the string contact surface is straight;

DETAILED DESCRIPTION OF THE INVENTION

Figure 1:
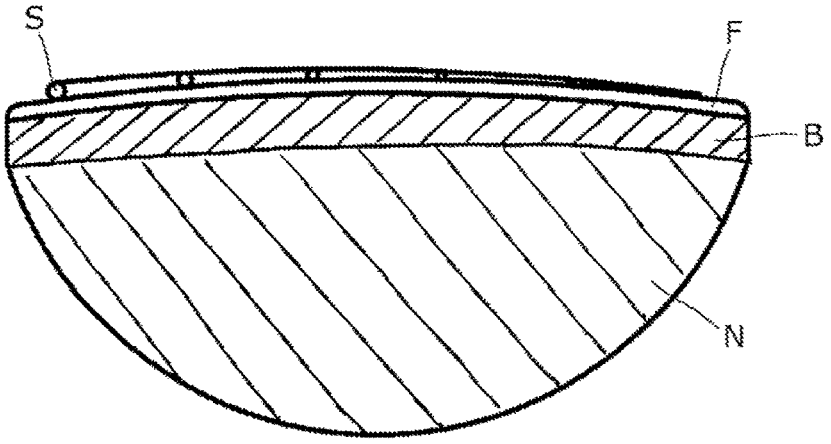
Fig. 1 PRIOR ART
FIG. 1 illustrates a guitar neck cross section well known in the prior art.
Figure 2A:
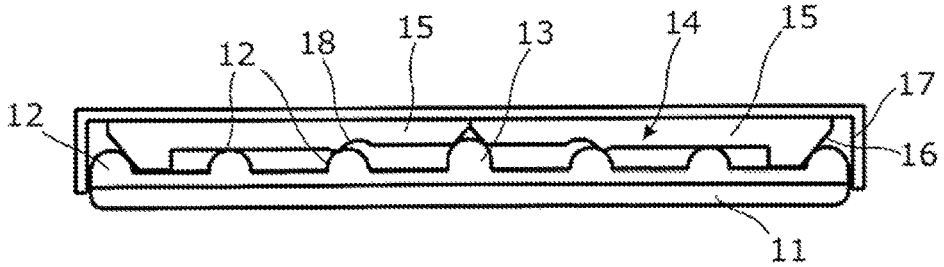
Figure 2B:
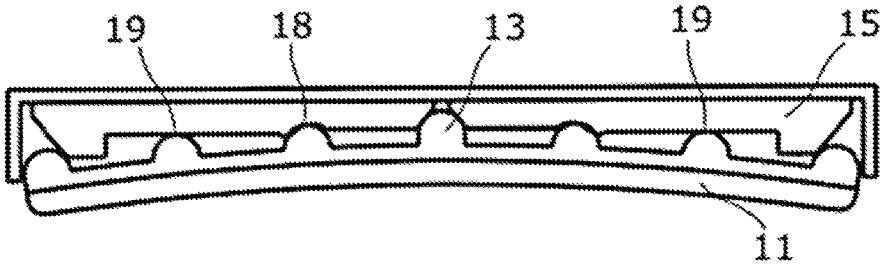

FIG. 2 illustrates a side section/internal view of a capo mechanism according to the invention. The mechanism is for incorporation into a top or clamp arm of a capo (not specifically shown in FIG. 2 but generally associated with a housing which defines a walled cavity 17), i.e. the arm which extends laterally over the neck and cooperates with a clamping mechanism to press the strings against a fret of the finger board, thereby adjusting its pitch. For scale, the cross width of a guitar neck at the nut is usually less than about 5 cm (2 inches) and, correspondingly, the length of the capo is normally a similar but slightly greater size. The thickness of the capo is normally less than 1 cm and the present invention will likely conform to similar dimensions (i.e. the depth of the illustrated capo mechanism will be in the order of 1 cm or less).

According to FIG. 2 a string pad 11 is arranged as a string contacting surface to, in use, face a finger board and contact with instrument strings. String pad 11 is preferably a resilient material capable of a degree of flex to form a curvature. On a rear side of string pad 11 a series of cam following contact surfaces 12 protrude therefrom that, in an unused state, maintain the string pad 11 in a relatively flat configuration. In the illustrated embodiment, a centermost protrusion 13 serves as an actuator and may be more pronounced than the remaining spaced-apart cam following surfaces 12. In the illustrated form there are six cam followers 12, three either side of actuator 13. Preferably each of the cam following contact surfaces 12 is rounded in order to smoothly contact and cooperate with a primary cam surface 14 against which they are located. The primary cam surface 14 is comprised of two cam carrier elements 15 that are slideable toward and away from each other, generally parallel to the string pad 11. Distal cam surfaces 16 have a sloped configuration for contact with the outermost cam followers 12. Such a linear cam arrangement transforms lateral movement L of the cam carrier elements 15 into a perpendicular (downward) force P at each distal edge of the string pad 11, thereby forming a curve as can be observed with reference to FIGS. 3 and 4.

The cam mechanism as illustrated is housed within a walled cavity 17 which is integral with the capo clamp arm/top bar. The cam mechanism could include further cams 16 (18) and corresponding followers 12 to give additional support, however, so long as sufficient stiffness is provided in string pad 11 then seven contact positions as illustrated suffices. Preferably, string pad 11 has resilience over its entire length to form smooth curves as required by the invention, yet stiff enough between supports (followers 12) so as not to deflect or deform too much under pressure from strings. Preferably tonal characteristics of the strings are maintained due to choice of material.

Figure 3A:
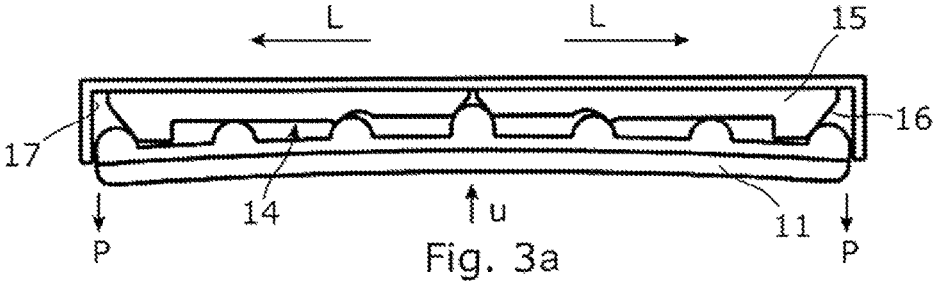
Figure 3B:
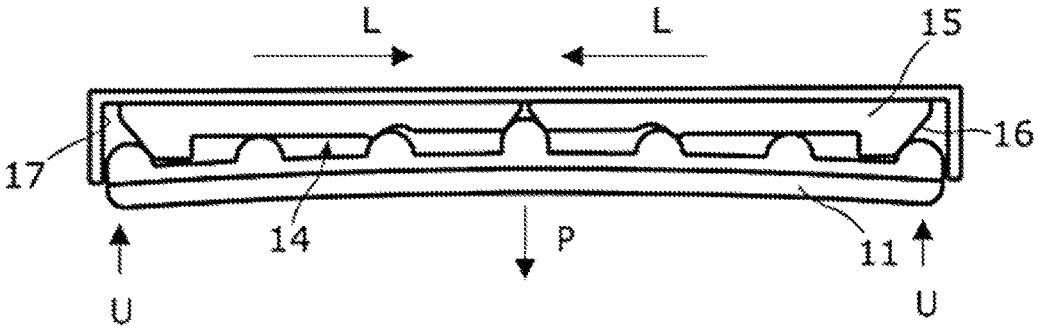

FIG. 3 illustrates initial engagement with an instrument finger board (not shown) where an apex of the finger board curve will contact the string pad 11 proximate with the actuator 13 protruding from the opposite side thereof. Upwards pressure in the direction of arrow U, via actuator 13, contacts an innermost sloped cam surface and forces cam carrier elements 15 to slide apart in the lateral direction L thereby engaging distal cam surfaces 16 with outermost cam followers 12. Intermediate cam surfaces 18 are also engaged which, in the illustrated form, allows the follower to move away from the fingerboard slightly as at the center to form the curve. It will be apparent that the cam surface 14 provides different effects on the overall curvature dependent on the location of a particular cam. Part of the cam surface may, in fact, be flat as denoted by area 19 in contact with a cam follower 12. In any event, the purpose of the curve adaption mechanism is to actively begin forming a curve in the contact surface before the full force of the capo clamp is applied, securing the capo to an instrument neck. This effect results in a more even clamping force on the strings since the contact surface has taken a curved configuration of its own.

Figure 4A:
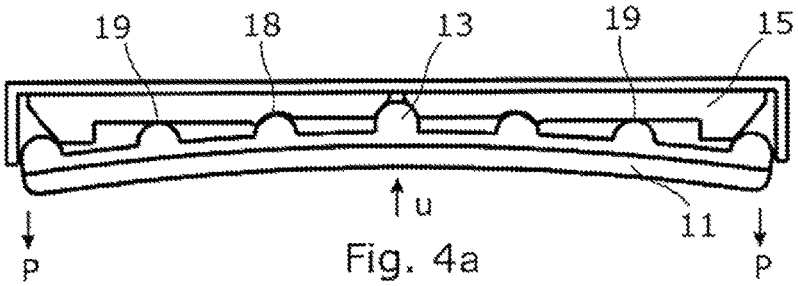
Figure 4B:
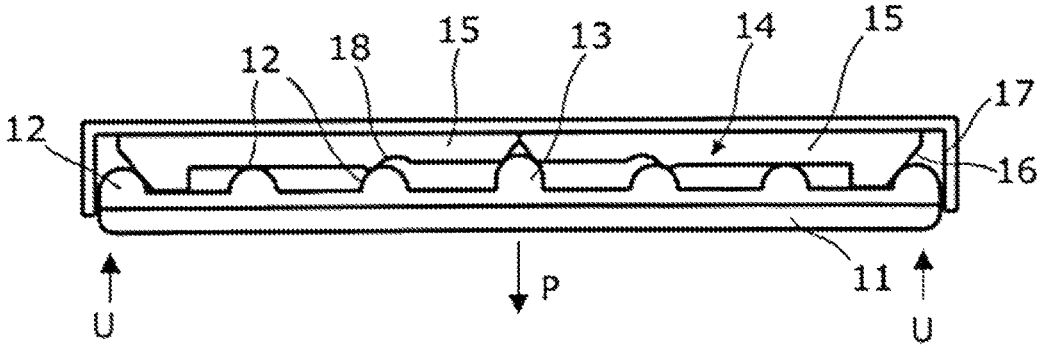

FIG. 4 illustrates a maximum curved condition of string pad 11 where actuator 13 (motivated by the apex of the fingerboard/string curve being clamped by the capo) is maximally extended and, likewise, distal cam surfaces 16 are at a maximum lateral distance apart from one another.

In the illustrated form of FIGS. 2 to 4 the cam surfaces 16 are shown as ramps but could be contoured to give different curvature characteristics to the string pad 11. Likewise, intermediate cam surfaces 18 and 19 can be modified to improve or specify alternative curvature other than an approximate universal radius. Such modifications and refinements are within the scope of the present invention.

Figure 10:
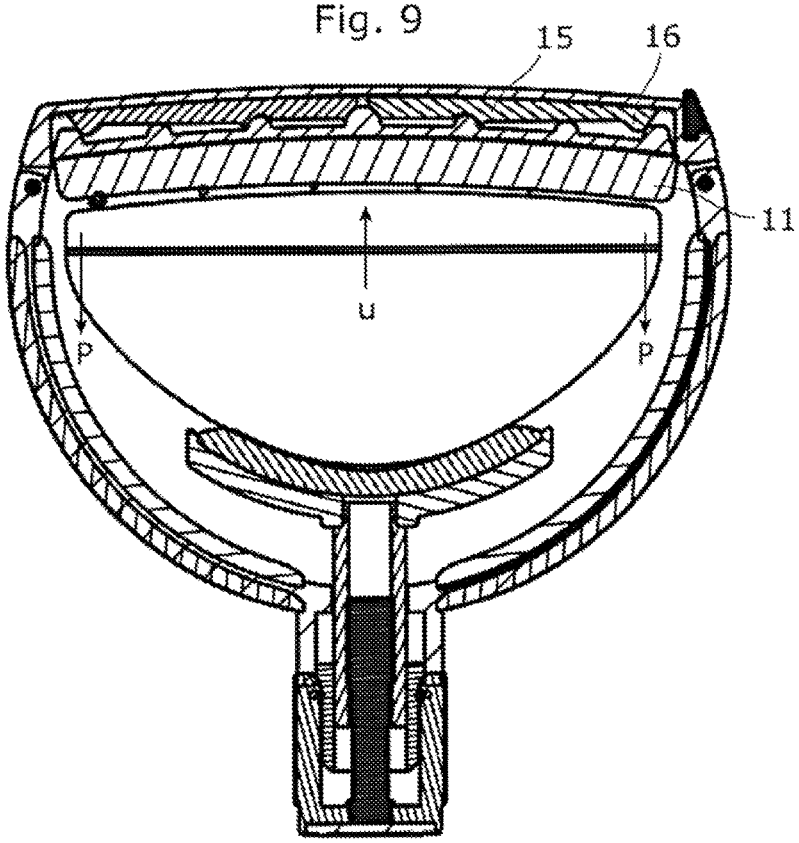
FIG. 10 illustrates an assembled view of a capo incorporating the curvature adaption mechanism of FIGS. 2 to 4.

FIG. 10 provides an overview of the first embodiment described above installed in a guitar capo.

Figure 5:
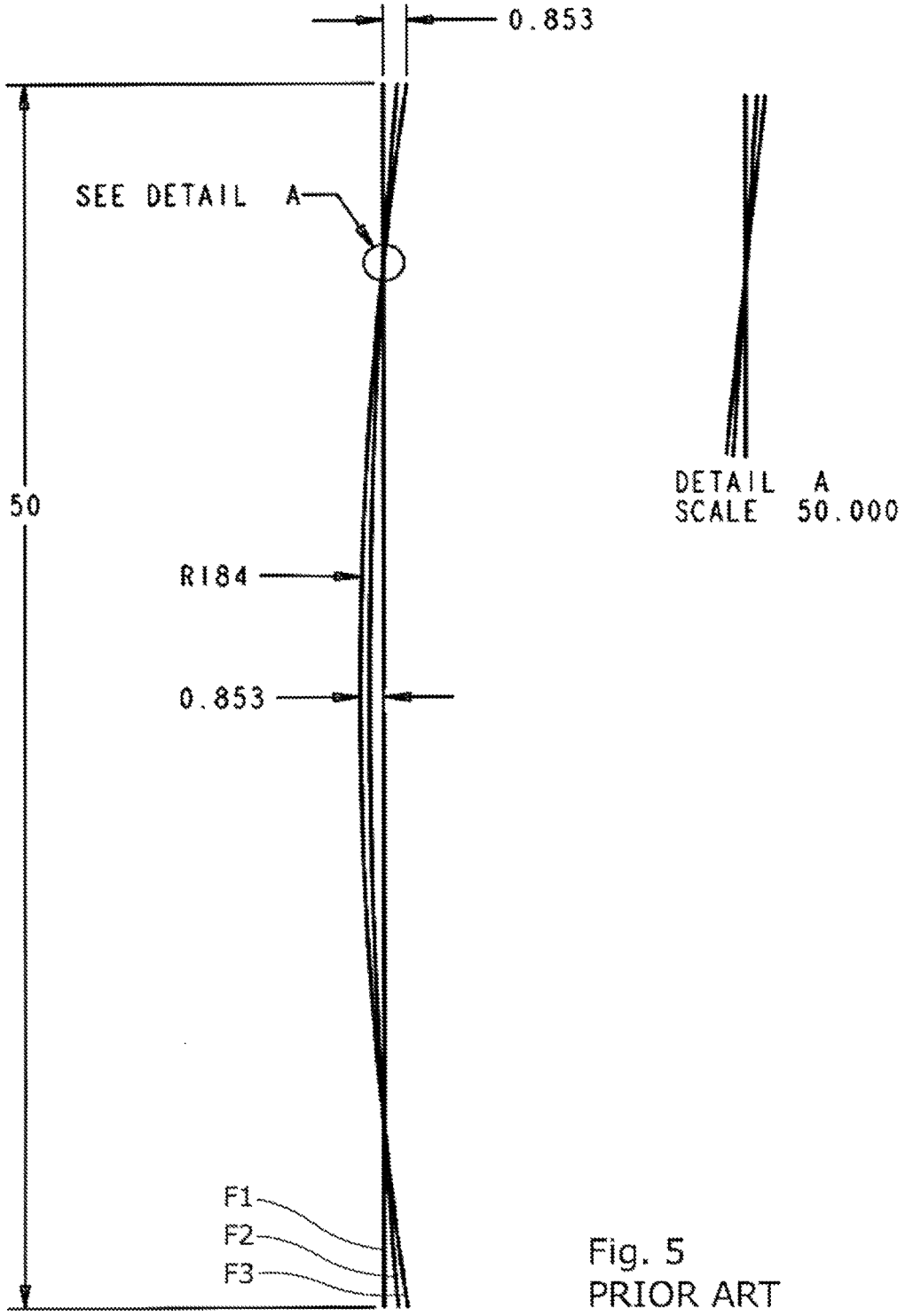
Fig. 5 PRIOR ART
FIG. 5 illustrates a general view of fingerboard curvature for standard guitar types.

FIG. 5 is provided merely to illustrate the relative dimensional relationship between different fingerboard curvatures F1, F2 and F3. Particularly, it is noted that at position A the curves pass through a point approximately common to all of them (roughly one sixth inboard from the distal ends of each curve). By electing to design the cam surfaces 16, 18 and 19 for this observation, it can render the arrangement simpler because "cam" 19 can be flat.

Figure 6:
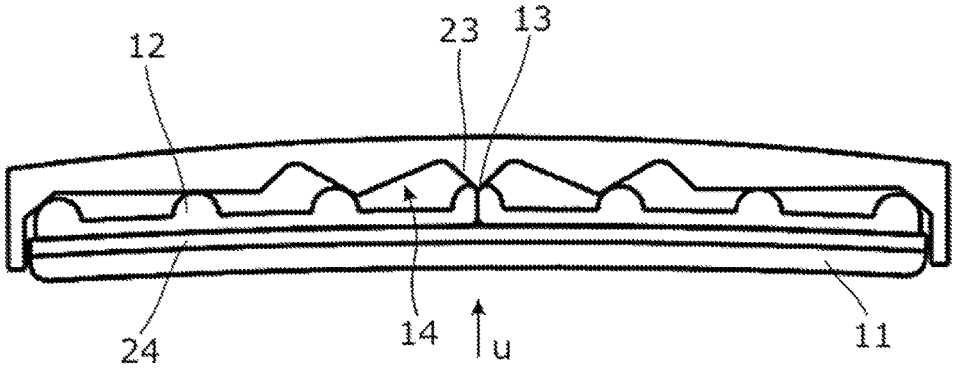
FIGS. 6 and 7 illustrate a second embodiment of curvature adaption mechanism according to the invention in stages of use.
Figure 7:
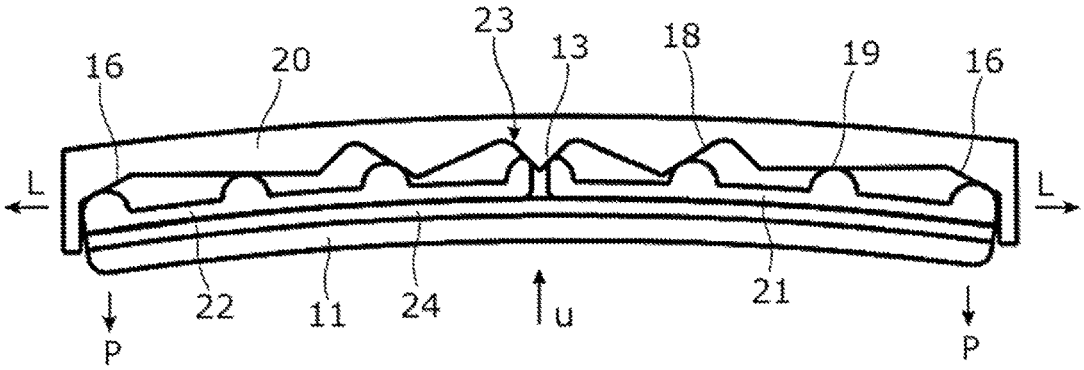

FIGS. 6 and 7 illustrate an alternative embodiment where the cam surfaces 16, 18 and 19 are able to be formed integrally with the top/clamp bar 20 of the capo. The "actuator" 13 to drive apart slideable cam follower carrier elements 21 and 22 is centrally formed with the cam surface 14 and extending downwardly. In other respects, the operation is analogous to the embodiment of FIGS. 2 to 4; i.e. by virtue of upward pressure U imparted by the finger board apex (not shown) cam follower carrier elements 21 and 22 are driven apart laterally in the direction of arrows L. Simultaneously, plural cam followers 12 engage with cam surfaces 16, 18, 19 and 23. The relative slope of a cam surface imparts a more or less severe downward force P that combines to form a curve in the string pad 11. In the second embodiment string pad 11 is formed of composite layers where a reinforcer 24 supports the material of string pad 11. In this way contact pad 11 may be softer than the first embodiment (and even possess string dampening characteristics) while the reinforcing backing 24 is hard (e.g. metal), yet flexible to adapt to curvature.

Figure 8:
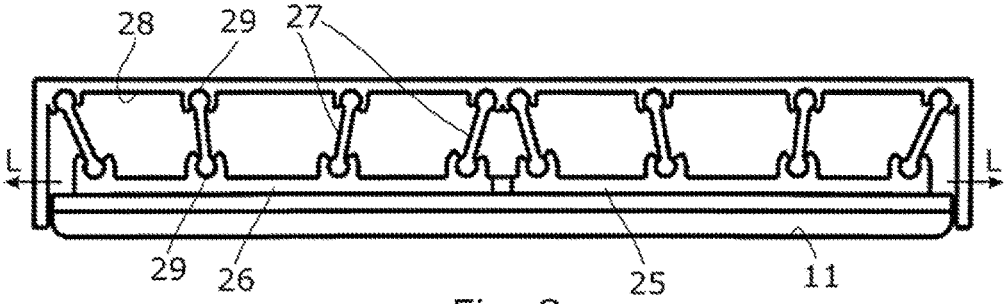
FIGS. 8 and 9 illustrate a third embodiment of curvature adaption mechanism according to the invention in stages of use.
Figure 9:
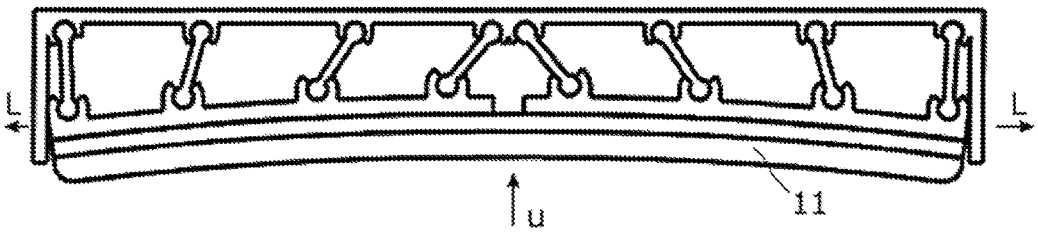

FIGS. 8 and 9 illustrate an alternative solution to the invention which also employs a mechanical means of achieving an adaptive radius, but utilizes levers/struts instead of cams.

According to FIG. 8 a pair of moveable (e.g. slidable) elements 25 and 26 associated with a rear (internal) side of a string contact pad 11 are connected via struts or levers 27 to a rigid surface 28, e.g. an internal wall of a capo clamp arm. In the illustrated form, struts 27 are hingedly mounted with hinges 29 misaligned so that at least some of the struts are generally arranged at angles.

FIG. 9 illustrates activation of the curvature mechanism where, as previously, the apex of a curved finger board (not illustrated) comes into contact with string pad 11, imparting an upward pressure U that forces apart slidable elements 25/26 laterally in the direction of arrow L. Hinge mounted struts 27 are caused to rotate with defined movements dictated by their fixed dimensions such that a controlled curvature is formed in the string pad 11. The lengths and angles and positions of the struts can be arranged to give a required curvature.

Figure 11:
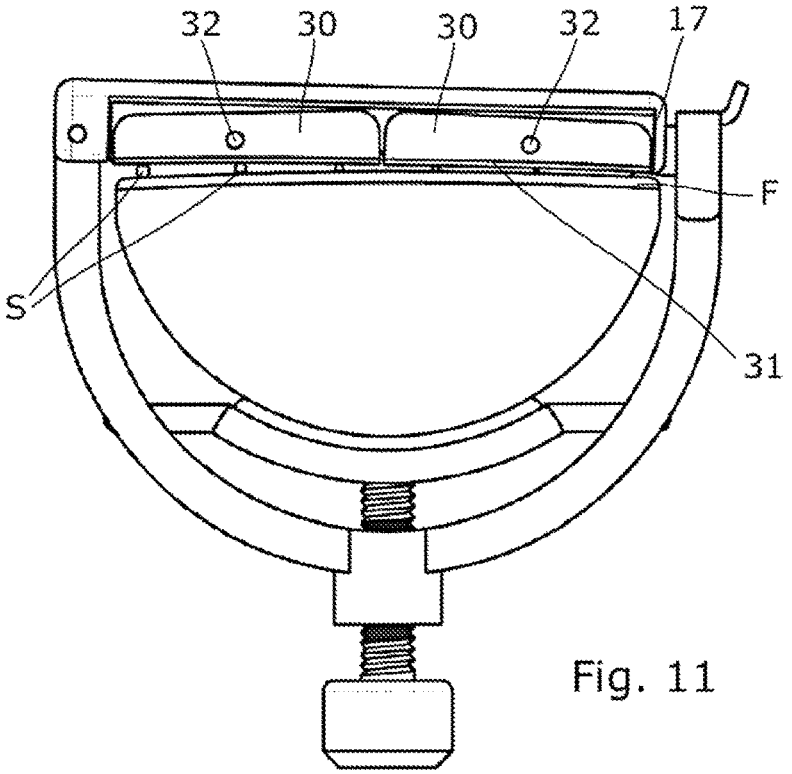
FIGS. 11 and 12 illustrate a fourth embodiment of a capo according to the invention.
Figure 12:
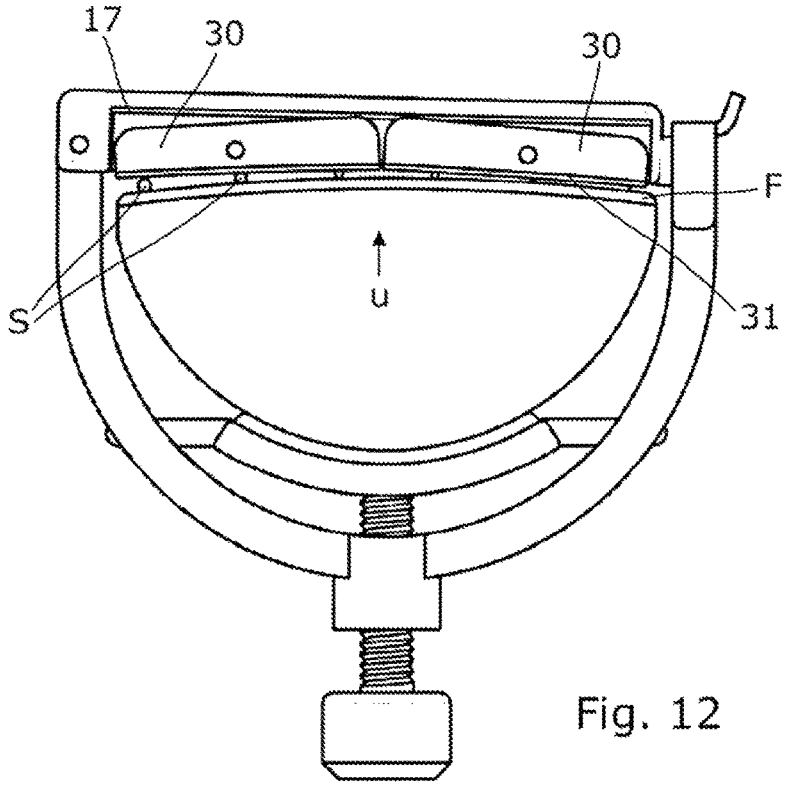

FIGS. 11 and 12 illustrate a further solution according to the invention where a pair of block elements 30 are located within a walled cavity 17 of the clamp arm, in contact with the strings S of an instrument (or incorporating a thin rubber contact surface 31) for rocking movement via pivot pins 32. FIG. 11 illustrates a situation where the fingerboard/fret curve F is relatively shallow; whereas FIG. 12 illustrates a more pronounced curve F. Operation of the mechanism in how it adapts to the curve, i.e. in response to an upward force U, is the same.

The embodiment of FIGS. 11 and 12 is based on the principle of splitting the strings S of an instrument into two (or more) groups, e.g. six strings into sets of three. The fingerboard/fret curve F over each set is relatively slight such that a block element associated with each, even with a flat contact surface 31, will quite closely adapt to the curve and apply relatively equal pressure to the strings. A thin layer of rubber can address any minor variations.

The advantage of a block element solution is that it enables a solid mass of material bearing onto the strings for minimal negative effect on tone and sustain.

A rocking block element solution could be implemented with a pivot pin 32 located at a mid-point of each block 30 as illustrated, or a radius formed on the opposite face to the contact surface (cooperating with an inner surface 17 of the clamp arm housing).

Rocking movement of a block element could also be actuated by cams, as described above, in reaction to pressure applied from the curved fingerboard surface F.

All embodiments of the invention can be incorporated into any known capo type.

Further modifications are possible, within the scope of the invention as devised. For example, the design could be such that the adaption mechanism is formed and therefore begins at a maximum curvature and, rather than pressure to the center, pressure at the outermost ends causes it to flatten; i.e. this would be a reverse embodiment to those illustrated. In the context of the invention the apex force would be substituted by a more general fingerboard curve force which, in this case, would be applied from the edges.

What is claimed is:

1. A capo for use with a stringed instrument having a neck with a back and a finger board with strings that extend longitudinally over said finger board, the capo including:

a first arm configured to, in use, extend laterally across the finger board over the strings;

a contact surface for contacting the strings in use; and an opposing element configured to, in use, abut against the back of the neck of the instrument to, in cooperation with the first arm, provide a clamping force via the contact surface over the strings;

a curvature adaption mechanism for dynamically altering a curvature of the contact surface, the curvature adaption mechanism having first and second slideable elements arranged for sliding movement toward and away from each other and at least one actuator protrusion engageable to drive the first and second slideable elements; wherein the curvature adaption mechanism includes a plurality of cams arranged to impart a differential feedback movement across the contact surface, in reaction to an opposing force supplied by the fingerboard and/or strings, thereby adjusting the curvature of the contact surface.

2. The capo of claim 1 wherein the contact surface has a straight initial configuration and the curvature adaption mechanism is adapted to increase the curvature of the contact surface as the capo is attached to the finger board.

3. The capo of claim 1 wherein the contact surface has a curved initial configuration and the curvature adaption mechanism is adapted to reduce the curvature of the contact surface as the capo is attached to the finger board.

4. The capo of claim 1 wherein the plurality of cams are arranged on the first and second slideable elements, such that lateral sliding of the first and second slideable elements causes the differential feedback movement to the contact surface.

5. The capo of claim 1 wherein the plurality of cams are arranged for cooperating with a plurality of cam follower surfaces.

6. The capo of claim 5 wherein the cam follower surfaces are arranged rearward of the string contact surface.

7. A capo for use with a stringed instrument having a neck with a back and a finger board with strings that extend longitudinally over said finger board, the capo including:

a first arm configured to, in use, extend laterally across the finger board over the strings;

a contact surface for contacting the strings in use; and an opposing element configured to, in use, abut against the back of the neck of the instrument to, in cooperation with the first arm, provide a clamping force via the contact surface over the strings;

a curvature adaption mechanism for dynamically altering a curvature of the contact surface; wherein the curvature adaption mechanism includes a plurality of struts arranged to impart a differential feedback force to the contact surface in reaction to an opposing force supplied by a curvature of the fingerboard and/or strings, the feedback force being differential across the contact surface, thereby adjusting a curvature in the contact surface.

8. The capo of claim 7 wherein the plurality of struts are arranged at an acute angle to the contact surface.

9. The capo of claim 8 wherein each end of a strut is arranged for pivoting movement.

10. The capo of claim 7 wherein the plurality of struts are arranged extending from a pair of slideable elements, such that lateral sliding of the slideable elements, in conjunction with the struts, causes the differential feedback force to the contact surface.

11. A capo for use with a stringed instrument having a neck with a back and a finger board with strings that extend longitudinally over said finger board, the capo including:

a first arm configured to, in use, extend laterally across the finger board over the strings;

a contact surface for contacting the strings in use; and an opposing element configured to, in use, abut against the back of the neck of the instrument to, in cooperation with the first arm, provide a clamping force via the contact surface over the strings;

a curvature adaption mechanism for dynamically altering a curvature of the contact surface; wherein the curvature adaption mechanism includes at least two block elements associated with the contact surface, each mounted for rocking movement, actuated in reaction to an opposing force supplied by a curvature of the fingerboard and/or strings.

12. The capo of claim 11 wherein each block element is mounted on a pin located at a mid-point thereof.

13. The capo of claim 11 wherein each block element includes a radial surface on a face opposite the contact surface, to enable the rocking movement.

14. The capo of claim 11 wherein each block element includes a flat face that forms the contact surface.

15. A capo for use with a stringed instrument having a neck with a back and a finger board with strings that extend longitudinally over said finger board, the capo including:

a first arm configured to, in use, extend laterally across the finger board over the strings;

a contact surface for contacting the strings in use; and an opposing element configured to, in use, abut against the back of the neck of the instrument to, in cooperation with the first arm, provide a clamping force via the contact surface over the strings;

a curvature adaption mechanism for dynamically altering a curvature of the contact surface; wherein the curvature adaption mechanism includes a plurality of cams arranged to impart a differential feedback movement across the contact surface, in reaction to an opposing force supplied by the fingerboard and/or strings, thereby adjusting the curvature in the contact surface; and wherein the plurality of cams are arranged for cooperating with a plurality of cam follower surfaces.

* * * * *